US006209988B1

(12) United States Patent
Sueoka et al.

(10) Patent No.: US 6,209,988 B1
(45) Date of Patent: Apr. 3, 2001

(54) INK JET RECORDING HEAD AND INK JET RECORDING APPARATUS

(75) Inventors: Manabu Sueoka; Toru Yamane, both of Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/229,994

(22) Filed: Jan. 14, 1999

(30) Foreign Application Priority Data

Jan. 22, 1998 (JP) ..... 10-010551

(51) Int. Cl.[7] ..... B41J 2/14
(52) U.S. Cl. ..... 347/50
(58) Field of Search ..... 347/20, 50, 63, 347/108, 152

(56) References Cited

U.S. PATENT DOCUMENTS 5,095,321 3/1992 Saito et al. ..... 347/63
5,436,649 7/1995 Nakagomi et al. ..... 252/500

FOREIGN PATENT DOCUMENTS 0 593 040 4/1994 (EP) .
0 670 220 9/1995 (EP) .
0 768 180 4/1997 (EP) .
0 769 378 4/1997 (EP) .
1-302829 12/1989 (JP) .

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

An ink jet recording head has a recording element unit including a recording element for generating an energy for jetting an ink and a connecting terminal connected to the recording element, a driving element unit including a driving element for driving the recording element and a connecting terminal connected to the driving element, a pressing force generating mechanism for generating a pressing force for pressing the recording element unit and the driving element unit so that the two connecting terminals are connected, and a pressing force transmission member for transmitting the pressing force to the recording element unit or the driving element unit while coming into contact therewith. An ink jet recording apparatus has the ink jet recording head and a member mounted with the ink jet recording head.

18 Claims, 14 Drawing Sheets

INK JET RECORDING HEAD AND INK JET RECORDING APPARATUS

BACKGROUND OF THE INVENTION

1. Field of the Invention

The present invention relates to an ink jet recording head for executing a record on a recorded medium by jetting inks, and to an ink jet recording apparatus including the ink jet recording head.

2. Related Background Art

An ink jet recording system has hitherto been adopted as a recording system in a recording apparatus such as a printer etc. The ink jet recording system may be a recording method, wherein inks are jetted out of orifices formed in an ink jet recording head and adhered to a recorded material such as a sheet of paper etc, thus performing the record. The ink jet recording system, which causes an extremely small amount of noise and is capable of high-speed recording, has therefore spread in recent years. What is known as the ink jet recording head is a head including a piezoelectric element and an exothermic element serving as an energy generating member for generating an energy utilized for jetting the inks out of the orifices. In particular, a so-called bubble jet type recording head is structured in such a way that bubbles are formed by applying the thermal energy generated by the exothermic element to the inks and heating the inks abruptly, and ink liquid droplets in ink channels are jetted out of the orifices by utilizing these bubbles. The thus structured recording head has advantages of exhibiting a high responding property to a recording signal and easily attaining a higher density.

A typical example of the ink jet recording head described above will be explained. FIG. 7 is a partially cut-off perspective view showing one example of a jetting element 1 related to the background art. A channel wall layer 121 serving as a recessed side wall for forming an ink channel 103 and a common ink chamber 104, is laminated on a recording element substrate 101, and a top plate 122 is laminated on the channel wall layer 121. An exothermic element 102 defined as an electro-thermal converting member as well as being an energy generating member for generating the energy utilized for jetting the inks, is provided, corresponding to each ink channel 103, on an insulating layer on an upper surface of the recording element substrate 101. Further, there are provided an unillustrated electric wire for electrifying each exothermic element 102 and a connecting terminal 110 disposed at an edge portion of the electric wire. One edge portions of the ink channels 103 are formed with orifices (jetting ports) 105 each opened to the outside, and the other edge portions communicate with the common ink chamber 104.

FIG. 8 is a perspective view showing one example of a recording element unit related to the background art. As illustrated in FIG. 8, the ink jetting element 1 described above is bonded to a base plate 107 having a positioning pin 108 and a positioning hole 109. In this case, the ink jetting element 1 is bonded thereto at a high relative positional accuracy with respect to the positioning pin 108 and the positioning hole 109. Then, the ink jetting element 1 is fitted with an ink supply member 106 for guiding the ink to the common ink chamber 104. The ink can be supplied to the ink supply member 106 from a separately provided ink tank (unillustrated). Thus, the recording element unit 10 including the ink jetting element 1 is constructed.

This recording element unit 10 is structured such that the exothermic element 102, upon receiving an electric signal, emits heat for heating the ink in the ink channel 103, then the heated ink bubbles up, and the ink is jetted out of the orifice 105 by dint of the bubbles, thus recording an image on the recorded medium.

Note that the recording element unit described above includes a plurality of recording elements (exothermic elements)-disposed therein, which must be each independently drive-controlled because of a plurality of dots being simultaneously recorded. A driving element for controlling the recording elements in this way is formed normally on a driving element substrate defined as a separate member from the recording element substrate. This driving element substrate is brought into press-contact with the recording element substrate, thereby connecting the driving elements to the recording elements. The reason for having adopted the construction described above is that if a defect appears in any one of the recording element and the driving element, and these elements are formed on the same substrate, then the whole unit would be deemed defective even if one element is normal. In such a case, there would be no alternative but to replace the substrate as it is mounted with the recording element and the driving element. By contrast, however, if the recording element and the driving element are formed on separate substrates, it might be sufficient that only the substrate having the defective element with respect to the recording element substrate and the driving element substrate is replaced while the normal substrate is not required to be replaced, which is efficient.

FIGS. 9 and 10 show a construction in which the recording element unit 10 formed with the exothermic elements (recording elements) 102 (not shown) and the driving element unit 20 on which to dispose the driving element for driving the exothermic elements, are provided as separate units and electrically connected by bringing their connecting terminals into press-contact with each other. FIG. 9 is an exploded perspective view showing one example of the recording element unit and the driving element unit related to the background art. FIG. 10 is a side view showing one example of the recording element unit and the driving element unit related to the background art.

The driving element unit 20 is constructed of a driving element substrate 4 provided with connecting terminals 23 to connect to connecting terminals 110 of the jetting element unit 1 and on which driving elements 22 are disposed. Printed circuit board (PCB) 5 is connected via a bonding wire 6 etc to the driving element substrate 4, and the driving element substrate 4 and the printed circuit board 5 are mounted to a base plate 21. The bonding wire 6, the connecting terminal 23 and the driving elements 22 are electrically connected to each other through unillustrated wiring patterns. The printed circuit board 5 is supplied with energy generating power and a driving signal from outside circuits via a cable 26. Further, the driving element unit 20 is provided with a positioning hole 15 and a positioning pin 14 which correspond to a positioning pin 108 and a positioning hole 109 of the recording element unit 10. Then, the cable 26 is attached to a rear portion of the printed circuit board 5, and the recording element unit 10 is fitted to the driving element unit 20 in a state where the unit 10 is turned over from the state shown in FIG. 8. At this time, the positioning pin 108 is fitted into the positioning hole 15, and the positioning pin 14 is fitted into the positioning hole 109 respectively, thus completing the positioning process. With this process, as schematically illustrated in FIG. 10, the connecting terminal 110 of the recording element unit 10 comes into direct-contact with the connecting terminal 23 of the driving element unit 20, thus taking a conduction therebetween. FIG. 10 is a side view showing one example of the recording element unit and the driving element unit related to the background art.

FIG. 11 is a side view showing another example of the recording element unit and the driving element unit related to the background art. Further, FIGS. 12A and 12B are partially enlarged side sectional views of FIG. 11. FIG. 12A shows a state before the connection, and FIG. 12B shows a state after the connection. Japanese Patent Application Laid-Open Publication No. 1-302829 discloses a construction in which, as illustrated in FIGS. 11, 12A and 12B, the two connecting terminals 110, 23 are connected to each other via an electric connecting member 310. This electric connecting member 310 includes a plurality of thin conductive members 311 embedded in an insulation holding body 312, thus giving a conduction in a vertical direction in FIGS. 11, 12A and 12B. Then, the electric connecting member 310 is sandwiched in between the recording element substrate 101 and the driving element substrate 4, and the connecting terminals 110, 23 are electrically connected by press-fitting the recording element substrate 101 and the driving element substrate 4 to each other.

Thus, when the recording element unit 10 and the driving element unit 20 are formed as the separate units, if a fault is caused in the recording element unit 10 or the recording element unit 10 becomes incapable of recording due to an expiration of its life-time, the system can be recovered simply by replacing only the recording element unit 10, which might be highly advantageous in terms of reducing the costs.

The conventional ink jet recording head having the recording element unit 10 described above which is replaceable, since it may be attached to and detached from the driving element unit 20, is provided with a press-fitting mechanism for applying pressure upon a joining portion between the recording element substrate 101 and the driving element substrate 4 in order to ensure the contact between the connecting terminals 110, 23. FIGS. 13A and 13B are partially-cut-off side views showing the press-fitting mechanism pertaining to the background art. FIG. 13A shows a state before the connection by this press-fitting mechanism. FIG. 13B shows a state of being connected.

Herein, a rotary shaft 35 is attached to a head base 50 on which the driving element unit 20 is placed. A spring-like resilient member 34 coming into contact with the recording element unit 10 is fitted to one edge portion of a press-fitting plate 33 rotatable about the rotary shaft 35. Further, a rotatable cam 32 is attached to the head base 50, and the other edge portion of the press-fitting plate 33 serves as an operating portion 33*a* capable of engaging with the cam 32. Then, when a lever (unillustrated) linked to the cam 32 is rotated from the state shown in FIG. 13A, the linked cam 32 rotates and pushes up the press-fitting plate 33, with the result that the press-fitting plate 33 rotates about the rotary shaft 35. Then, the connecting terminal 23 of the recording element unit 20 is pushed against and thus connected to the connecting terminal 110 of the driving element unit 10 by a desired pressing force given from the resilient member 34 fixed to the press-fitting plate 33.

In the press-fitting mechanism shown in FIG. 13A and 13B, as the press-fitting plate 33 moves while rotating about the rotary shaft 35, the resilient member 34 comes into contact with the recording element unit 10 and pushes up the recording element unit 10 to such an extent that the connecting terminal 110 of the recording element unit 10 impinges upon the connecting terminal 23 of the driving element unit 20. The resilient member 34 makes the recording element unit 10 further intruded, thereby generating a pressing force acting upon the recording element unit 10 due to a flexure of the resilient member 34 itself. In the process of giving this pressing force, however, a contact position between the resilient member 34 and the recording element unit 10 has a deviation 6 as shown in FIG. 14 in terms of a relationship between a rotational shift of the fitting position of the resilient member 34 and a quantity of deformation of the resilient member 34. Therefore, the recording element unit 10 is unable to be pushed strictly perpendicularly to the driving element unit 20, resulting in a problem in which a well-connected state is obtained with a difficulty. FIG. 14 is a partially enlarged cut-off side view of FIGS. 13A and 13B.

Especially when the recording elements 102 and the orifices 105 are arranged with a high density in order to correspond to hyperfine printing and a speed-up thereof, the number of the connecting terminals 110, 23 also increases with a high density, and therefore the deviation of the contact position between the resilient member 34 and the recording element unit 10 might make incomplete the electric connection between the two connecting terminals 110, 23.

SUMMARY OF THE INVENTION

It is a primary object of the present invention to provide an ink jet recording head and an ink jet recording apparatus which are capable of attaining a more ensured electric connection between a recording element unit and a driving element unit.

To accomplish the above object, according to one aspect of the present invention, an ink jet recording head comprises a recording element unit including a recording element for generating an energy utilized for jetting an ink and a connecting terminal connected to the recording element, a driving element unit including a driving element for driving the recording element and a connecting terminal connected to the driving element, a pressing force generating mechanism for generating a pressing force for pressing the recording element unit and the driving element unit in such a direction as to make the recording element units and the driving element units proximal to each other so that the two connecting terminals are connected to each other, and a pressing force transmission member interposed between the pressing force generating mechanism, the recording element unit and the driving element unit and having a rigidity enough to transmit the pressing force to the recording element unit or the driving element unit while coming into contact with the recording element unit or the driving element unit so that the pressing force given from the pressing force generating mechanism acts upon a connecting portion between the two connecting terminals.

According to another aspect of the present invention, an ink jet recording apparatus comprises the thus constructed ink jet recording head, whereby a high reliability is exhibited.

According to the present invention, there is no deviation of a contact position (pressing force acting position) between the pressing force transmission member having a rigidity and the recording element unit or the driving element unit, and the pressing force can be surely transmitted, whereby an assured electric connection between the recording element unit and the driving element unit can be obtained.

According to the present invention, it is preferable that two pluralities of connecting terminals of the recording element unit and of the driving element are each arranged in line, and that the pressing force transmission member makes the pressing force act directly linearly upon regions corresponding to the lines of the two pluralities of connecting terminals. It is also preferable in terms of a certainty of the electric connection that the pressing force acts substantially perpendicularly to the surface on which the two connecting terminals are disposed. It is preferable as a specific construction for attaining what is described above that the central axis of the rotation of the pressing force transmission member is substantially flush with the contact position between the pressing force transmission member and the recording element unit or the driving element unit.

According to the present invention, it is preferable that the pressing force transmission member is divided into a plurality of pressing force transmission sub-members in an array direction of the recording elements of the recording element unit, and it is more preferable that the pressing force generating mechanism is divided into a plurality of pressing force generating sub-mechanisms corresponding to the divided pressing force transmission sub-members. Based on this construction, it is feasible to exert the pressing force substantially equally over an entire width of even a wider ink jet recording head of a full-line type etc, finely corresponding to warping and waviness of the recording element unit and the driving element unit.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS

Embodiments of the present invention will hereinafter be described with reference to the accompanying drawings. Note that a recording element unit 10 and a driving element unit 20 have constructed substantially the same as those shown in FIGS. 7 to 10, and hence the constructions thereof are explained referring to those Figures.

Figure 7:
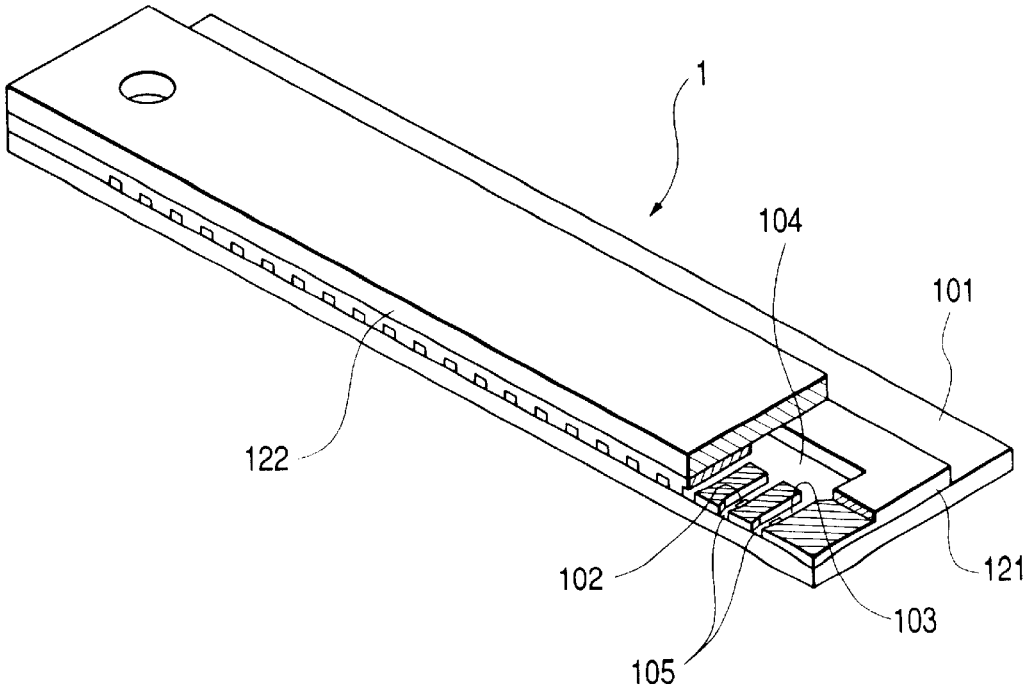
FIG. 7 PRIOR ART
FIG. 7 is a partially cut-off perspective view showing one example of an ink jet element related to the background art.
Figure 8:
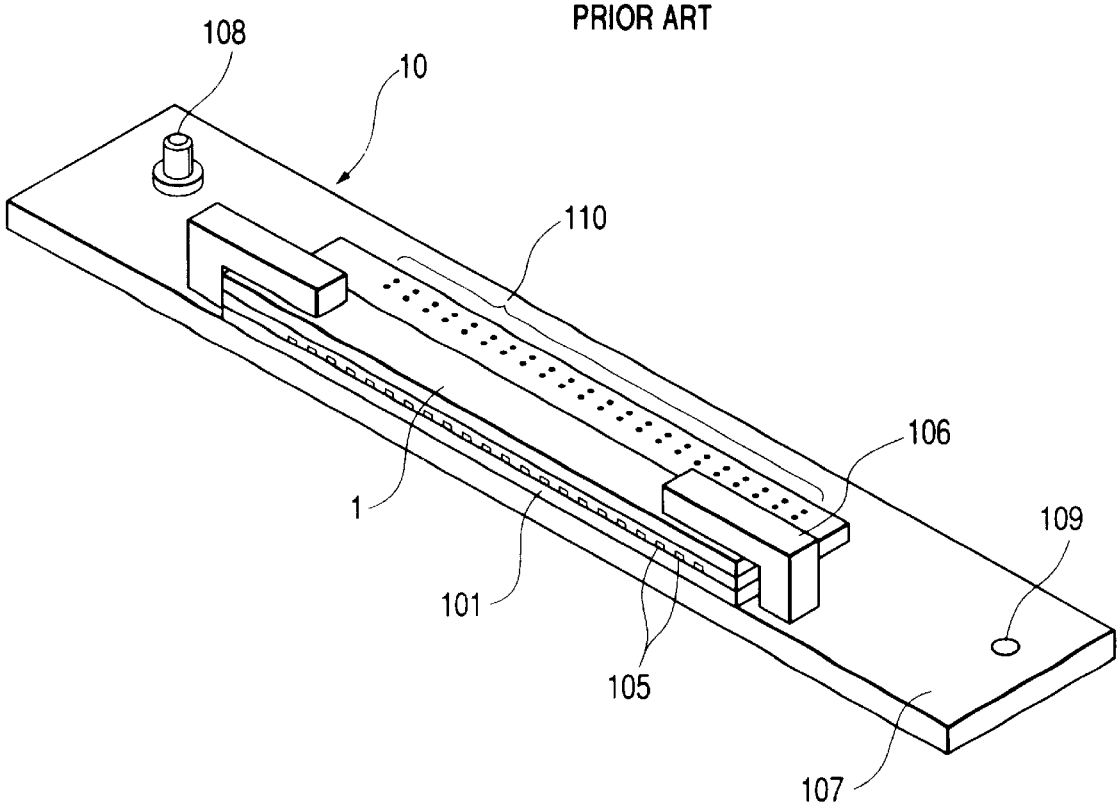
FIG. 8 PRIOR ART
FIG. 8 is a perspective view showing one example of a recording element unit related to the background art.

As shown in FIG. 7, a recording element substrate 101 of an ink jet element 1 is constructed such that the substrate composed of silicon and a metal is coated with $SiO_2$ as an insulating layer. An $HfB_2$ layer for forming an exothermic element 102 serving as an energy generating body for generating an energy utilized for jetting inks, is formed on the insulating layer, and a connecting terminal 110 (FIG. 8) is disposed at an edge portion of an electrode for electrifying the exothermic element 102. Ink channels 103 are formed in portions corresponding to the exothermic elements 102 on the recording element substrate 101, and a common ink chamber 104 communicating with each of the ink channels 103 is further formed. As illustrated in FIG. 8, the ink jet element 1 is bonded at a high positional accuracy to a base plate 107 composed of aluminum (Al) and having a positioning pin 108 and a positioning hole 109, and further ink supply members 106 for guiding the inks to the common ink chamber 104 of the ink jet element 1 are fitted to the base plate 107.

Figure 9:
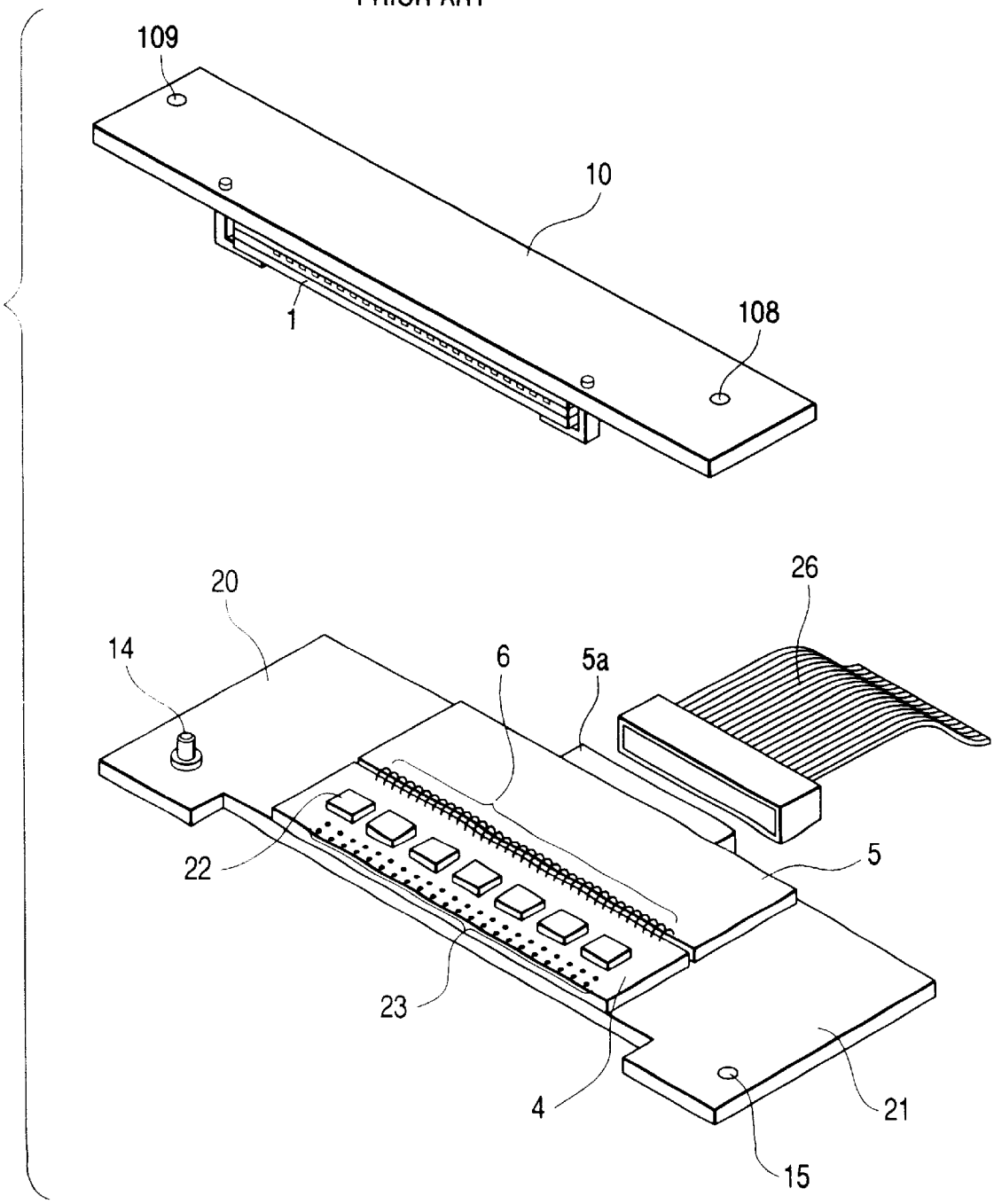
FIG. 9 PRIOR ART
FIG. 9 is an exploded perspective view showing one example of the recording element unit and the driving element unit related to the background art.
Figure 10:
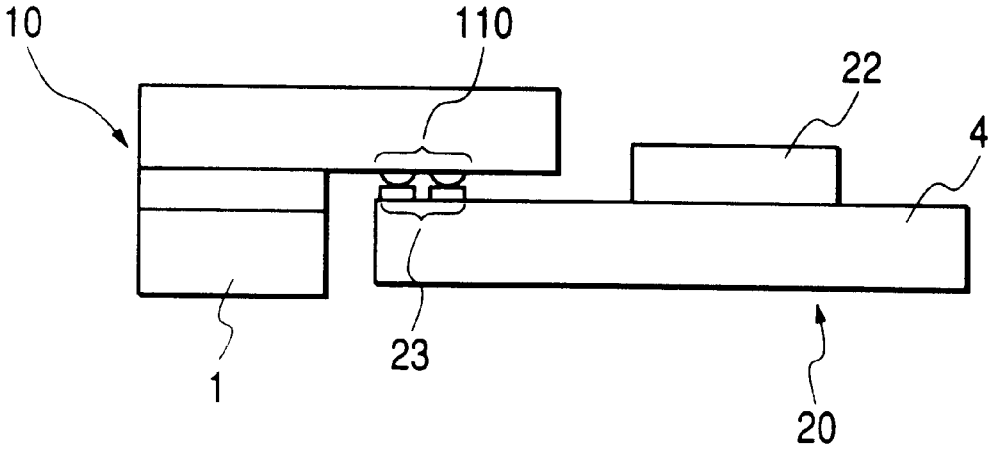
FIG. 10 PRIOR ART
FIG. 10 is a side view showing one example of the recording element unit and the driving element unit related to the background art.

As shown in FIG. 9, a driving element substrate 4 of a driving element unit 20 is packaged with driving elements 22 each structured in the form of an IC chip for driving the exothermic element 102. The driving elements 22 are electrically connected to a printed circuit board 5 via a bonding wire 6, and the printed circuit board 5 is provided with a connector 5*a,* for taking in a driving signal and driving electric power as well from outside, to which a cable 26 for transmitting an electric signal is attached. The thus constructed recording element unit 10 is joined to the driving element unit 20, and positioning pins 108, 14 provided respectively are fitted into positioning holes 109, 15, whereby connecting terminals 110, 23 are, as shown in FIG. 10, connected with a high accuracy.

First Embodiment

Figure 1:
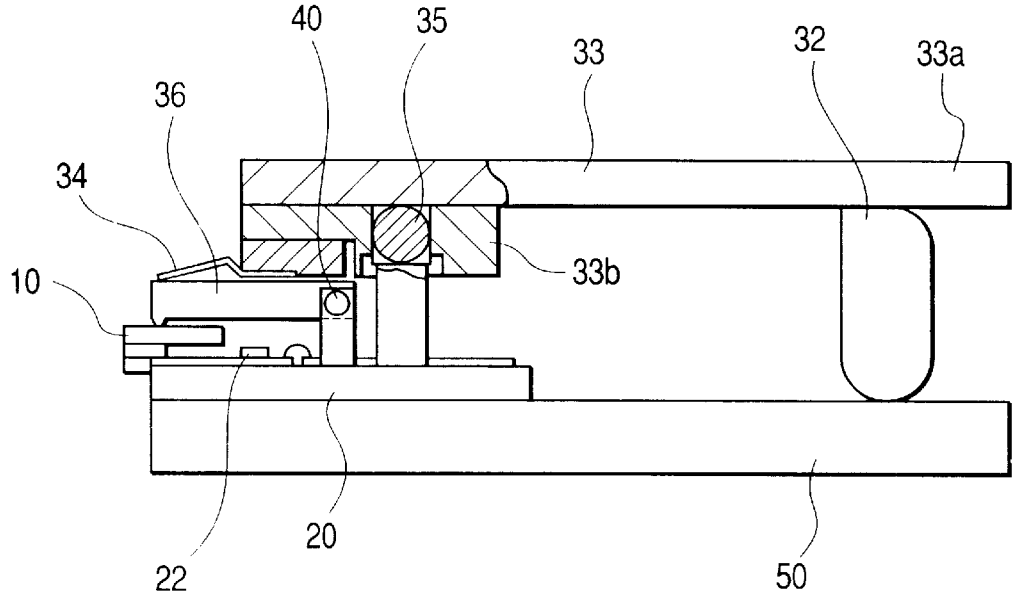
FIG. 1 is a partially cut-off side view showing an ink jet recording head in a first embodiment of the present invention.

FIG. 1 is a partially cut-off side view showing an ink jet recording head in a first embodiment of the present invention. A head base 50 is fitted with the driving element unit 20, a rotatable cam 32, and a lever (unillustrated) connected to the cam 32. The driving element unit 20 on the head base 50 is fitted with a rotary shaft 35 to which a fitting portion 33*b* of a press-fitting plate 33 is attached, and with a pressing force transmission member 36 rotatable about the rotary shaft 40. A spring-like resilient member 34 is provided at one edge portion of the press-fitting plate rotatable about the rotary shaft 35, and the other edge portion of the press-fitting plate 33 serves as an operating portion 33*a* brought into contact with the cam. A mechanism, which includes at least the cam 32, the press-fitting plate 33 and the resilient member 34 and exerts a pressing force upon the pressing force transmission member 36, is generically referred to as a "pressing force generating mechanism". The pressing force transmission member 36 coming into contact with the resilient member 34 of the press-fitting plate 33 has a rigidity to such an extent that the member 36 is not deformed even by pressing the recording element unit 10 while rotating it, and is composed of a metal and ceramic etc.

An operation of this press-fitting mechanism is explained. To start with, the driving element unit 20 and the recording element unit 10 are placed on the head base 50, in which state the cam 32 is rotated by moving the lever (not shown). Thereupon, with a rotating operation of the cam 32, the operating portion 33*a* of the press-fitting plate 33 is pushed up, with the result that the press-fitting plate 33 rotates about the rotary shaft 35. Then, the resilient member 34 fitted to the press-fitting plate 33 comes into contact with the pressing force transmission member 36. Subsequently, the pressing force transmission member 36 rotates about the rotary shaft 40 impinges upon the recording element unit 10. As shown in FIG. 1, in a state where the cam 32 pushes up the operating portion 33*a* of the press-fitting plate 33 at the maximum, the recording element unit 10 is pressed by the pressing force of the pressing force transmission member 36 in such a direction as to become proximal to the driving element unit 20, whereby the connecting terminal 110 of the recording element unit 10 is brought into press-contact with the connecting terminal 23 of the driving element unit 20. The pressing force of the pressing force transmission member is absorbed to some extent by a flexure deformation of the resilient member 34, and an adjustment is made so as not to apply an excessive load.

At this time, the pressing force transmission member 36 is supported by the driving element unit 20 and has no flexure deformation during a series of these operations, and therefore it never happens that a deviation is caused with respect to the recording element unit 10. Accordingly, the connecting terminal 110 of the recording element unit 10 is surely electrically connected to the connecting terminal 23 of the driving element unit 20.

Further, in accordance with the first embodiment, a plurality of the connecting terminals of the recording element units and a plurality of the connecting terminals of the driving element unit, are both arranged in lines, and the pressing force transmission member makes the pressing force act directly linearly upon regions corresponding to the lines of the pluralities of the connecting terminals of both of units. This construction is therefore preferable in terms of a certainty of the electric connection. Further, the above pressing force acts substantially perpendicularly upon the surfaces on which the two groups of connecting terminals are disposed, which is also preferable in terms of the certainty of the electric connection.

Second Embodiment

Figure 2:
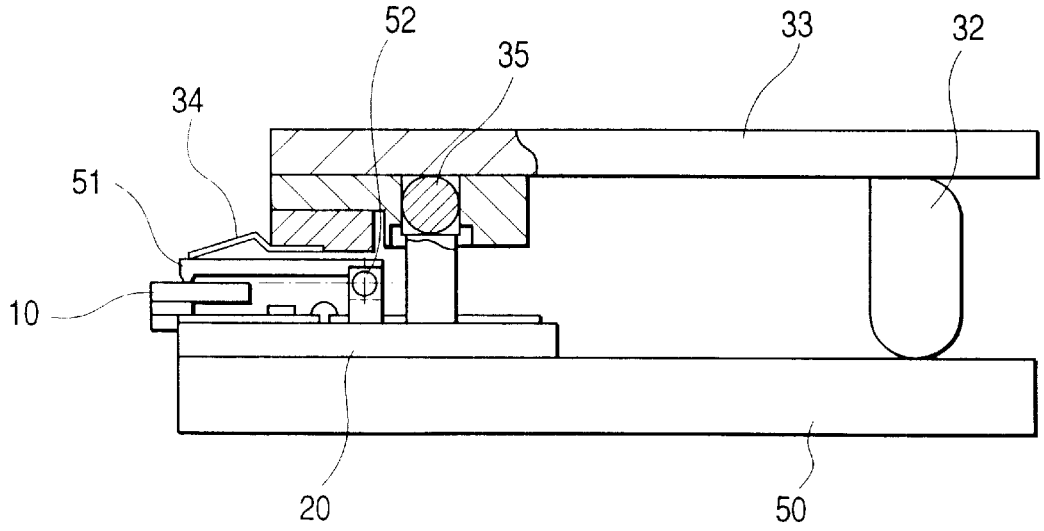
FIG. 2 is a partially cut-off side view showing the ink jet recording head in a second embodiment of the present invention.

FIG. 2 is a partially cut-off side view showing the ink jet recording head in a second embodiment of the present invention. A difference in terms of the construction in the second embodiment from the first embodiment is that a pressing force transmission member 51 and a rotary shaft 52 are provided so that the center of the rotary shaft 52 of the pressing force transmission member is substantially flush with an upper surface of the recording element unit 10 in a state of its being placed together with the driving element unit 20 on a head base 50. With this contrivance, the pressing force acts only in a direction substantially perpendicular to the joining surface between the recording element unit 10 and the driving element unit 20, whereby a more assured electric connection can be attained. Note that other configurations are the same as those in the first embodiment, of which the explanation is therefore omitted.

Third Embodiment

Figure 3:
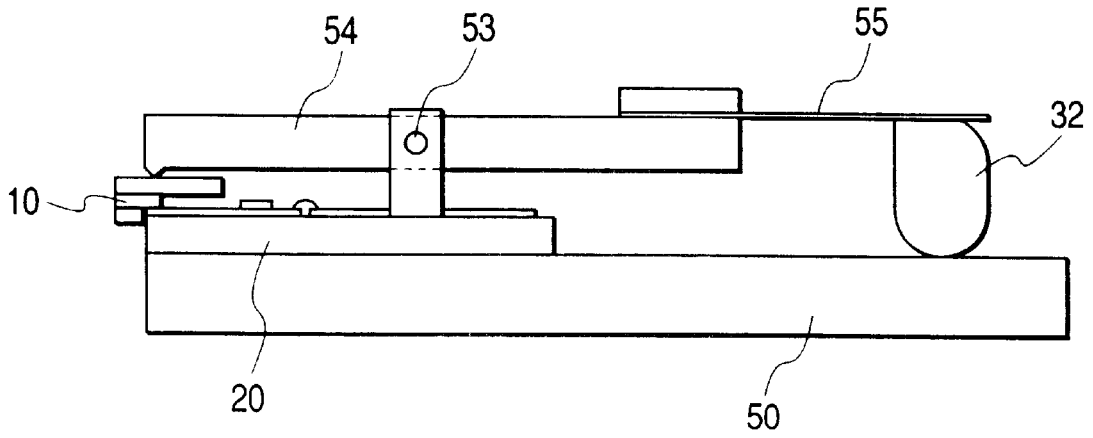
FIG. 3 is a side view showing the ink jet recording head in a third embodiment of the present invention.

FIG. 3 is a side view showing the ink jet recording head in a third embodiment of the present invention. In the third embodiment, the same recording element unit 10 and driving element unit 20 as those in the first embodiment, are placed on the head base 50. A pressing force transmission member 54 rotatable about a rotary shaft 53 is fitted to the driving element unit 20. One edge of the pressing force transmission member 54 can be brought into direct contact with the upper surface of the recording element unit 10. A plate spring-like resilient member 55 is attached to the other edge of the pressing force transmission member 54. Then, this resilient member 55 serves an operating portion coming into contact with the cam 32.

Based on this construction, when the cam 32 rotates upon operating the unillustrated lever, the cam 32 pushes up the resilient member 55, and the pressing force transmission member 54 fixedly fitted to the resilient member 55 rotates about the rotary shaft 53, with the result that a front edge of the pressing force transmission member 54 impinges upon the upper surface of the recording element unit 10. Thereafter, when the cam 32 further rotates, the pressing force transmission member 54 presses the recording element unit 10 by a substantially fixed pressing force while causing a flexure deformation of the resilient member 55. As in the first embodiment, the pressing force transmission member 55 coming into direct contact with the recording element unit 10 is not deformed in flexure, and hence the deviation as occurred in the prior art does not appear between the pressing force transmission member 55 and the upper surface of the recording element unit 10. There by obtaining the ensured electric connection between the connecting terminal 110 of the recording element unit 10 and the connecting terminal 23 of the driving element unit 20.

Further, according to the third embodiment, the number of parts can be reduced, and therefore the costs can be decreased. Moreover, a thickness of the whole recording head can be made smaller than in the first embodiment, which is effective in downsizing the recording apparatus. Further, in the recording apparatus structured such that a plurality of recording heads are arranged for executing a color recording process, a pitch between the recording heads disposed in a side-by-side relationship can be decreased. If the head-to-head pitch is large, this might cause a deterioration in accuracy because of the recorded medium being made elastic and fed in ununiformity, which consequently leads to a decline in a recording quality. In the third embodiment, however, it is feasible to decrease the pitch between the recording heads as described above, and the recording accuracy can be therefore enhanced. In particular, that might be extremely effective when adopting the recording apparatus for effecting the color record, wherein the positional adjustment must be precisely done so that dots in respective colors are overlapped.

Fourth Embodiment

Figure 4:
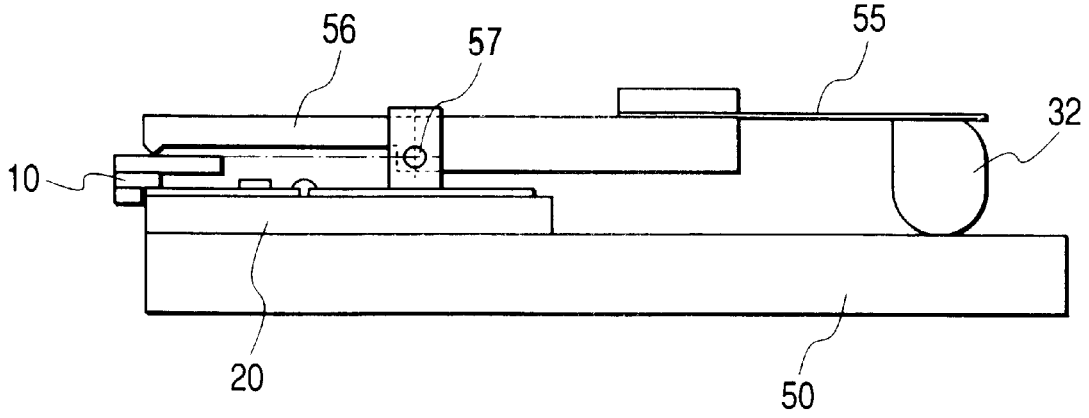
FIG. 4 is a side view showing the ink jet recording head in a fourth embodiment of the present invention.

FIG. 4 is a side view showing the ink jet recording head in a fourth embodiment of the present invention. A difference in terms of the construction from the third embodiment is that a pressing force transmission member 56 and a rotary shaft 57 are provided so that the center of the rotary shaft 57 of the pressing force transmission member 56 is substantially flush with the upper surface of the recording element unit 10 in a state of its being placed together with the driving element unit 20 on the head base 50. With this contrivance, as in the second embodiment, the pressing force acts only in the direction substantially perpendicular to the joining surface between the recording element unit 10 and the driving element unit 20, whereby a more assured electric connection can be attained. Note that other configurations are the same as those in the third embodiment, of which the explanation is therefore omitted.

Fifth Embodiment

Figure 5:
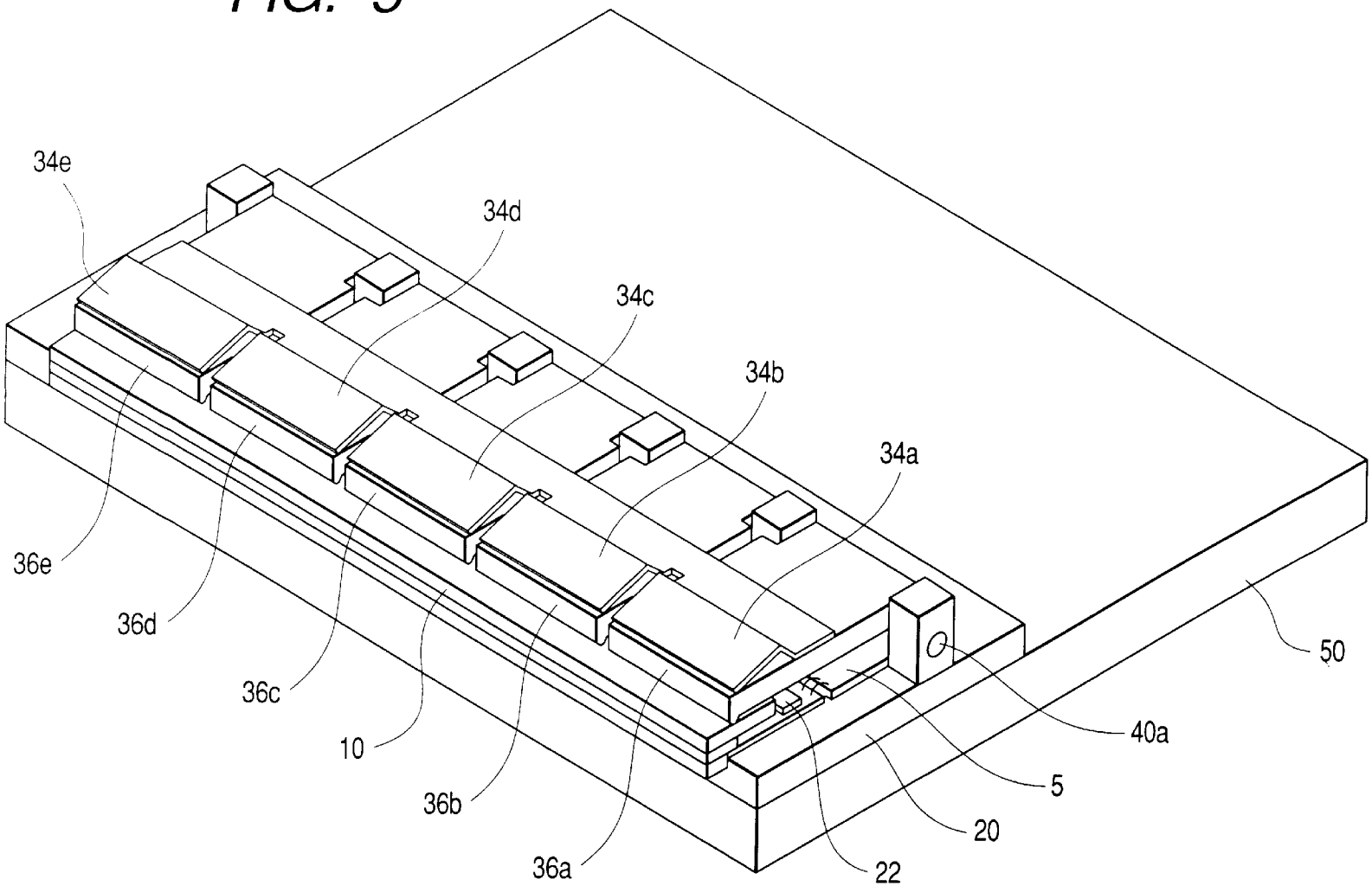
FIG. 5 is a perspective view showing the ink jet recording head in a fifth embodiment of the present invention.

FIG. 5 is a side view showing the ink jet recording head in a fifth embodiment of the present invention. In the first and second embodiments, the single pressing force transmission member is provided for one joining body of the recording element unit 10 and the driving element unit 20. In the fifth embodiment, however, a plurality (e.g., five) of pressing force transmission members 36*a* to 36*e* are provided for one joining body of the recording element unit 10 and the driving element unit 20. FIG. 5 shows only resilient members 34*a* to 34*e* fixed to the pres-fitting plate 33 with an omission of the illustrations of the cam 32, the press-fitting plate 33 and the rotary shaft 35. Each of the pressing force transmission members 36*a* to 36*e* has substantially the same construction as that in the first embodiment. In the fifth embodiment, however, the resilient members and the pressing force transmission members are provided separately in a plurality of positions in a widthwise direction of the head (which is an array direction of the recording element 10). Then, each of the pressing-force transmission members 36*a* to 36*e* is attached to each of rotary shafts (of which four rotary shafts are omitted in their illustration excluding a rotary shaft 40*a*), and is independently rotatable.

In the fifth embodiment, even when warping and waviness occur in the recording element unit 10 or the driving element unit 20, the plurality of separate pressing force transmission members 36*a* to 36*d* are individually, independently brought into contact with the recording element unit 10, and hence the pressing force can be equally distributed over an entire width of the recording element unit 10. Accordingly, it is possible to correspond to a wider recording head, e.g., an ink jet recording head of a full-line type having an A4 width or an A3 width, and the assured electric connection can be attained. Incidentally, it is preferable that the cam 32, the press-fitting plate 33 and the rotary shaft 35, though not illustrated, are each separately provided in a plurality of positions corresponding to the pressing force transmission members 36*a* to 36*e*.

Sixth Embodiment

Figure 6:
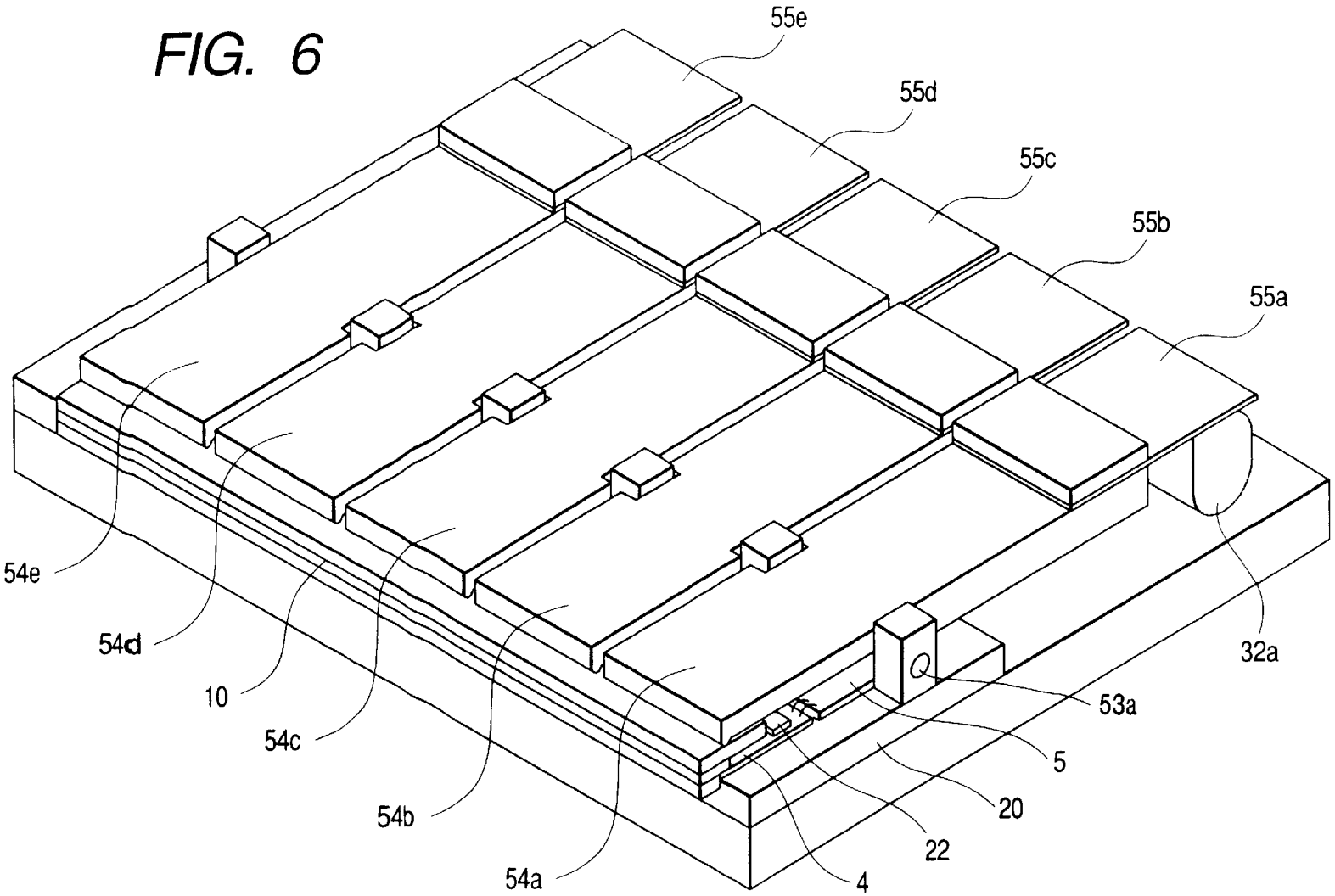
FIG. 6 is a perspective view showing the ink jet recording head in a sixth embodiment of the present invention.

FIG. 6 is a side view showing the ink jet recording head in a sixth embodiment of the present invention. In the sixth embodiment, based on substantially the same construction in the third embodiment, a plurality of pressing force transmission members are provided as in the fifth embodiment. To be more specific, for one joining body of the recording element unit 10 and the driving element unit 20, there are provided a plurality (e.g., five) of pressing force transmission members 54*a* to 54*e*, a plurality of cams (of which four cams are omitted in their illustration excluding a cam 32*a*), a plurality of rotary shafts (of which four rotary shafts are omitted in their illustration excluding a rotary shaft 53*a*), and a plurality of resilient members 55*a* to 55*e*. According to the sixth embodiment also, as in the fifth embodiment, the plurality of separate pressing force transmission members 54*a* to 54*e* are each independently capable of equally distributing the pressing force over the entire width of the recording element unit 10 while being in contact therewith, thereby exhibiting an effect of being able to correspond to the wider recording head.

Figure 11:
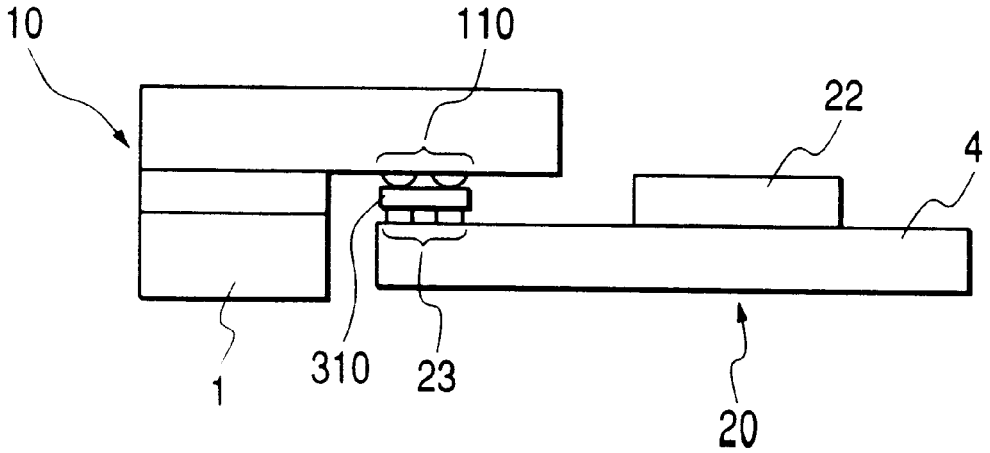
FIG. 11 PRIOR ART
FIG. 11 is a side view showing another example of the recording element unit and the driving element unit related to the background art.
Figure 12A:
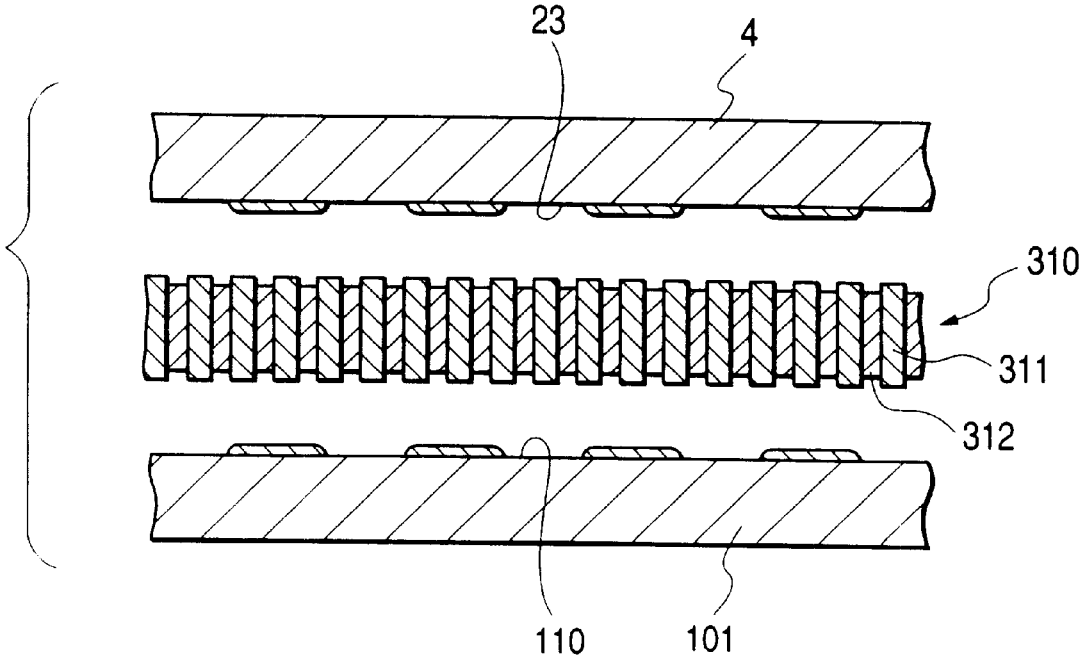
FIG. 12A PRIOR ART
FIGS. 12A and 12B are partially enlarged side sectional views of FIG. 11.
Figure 12B:
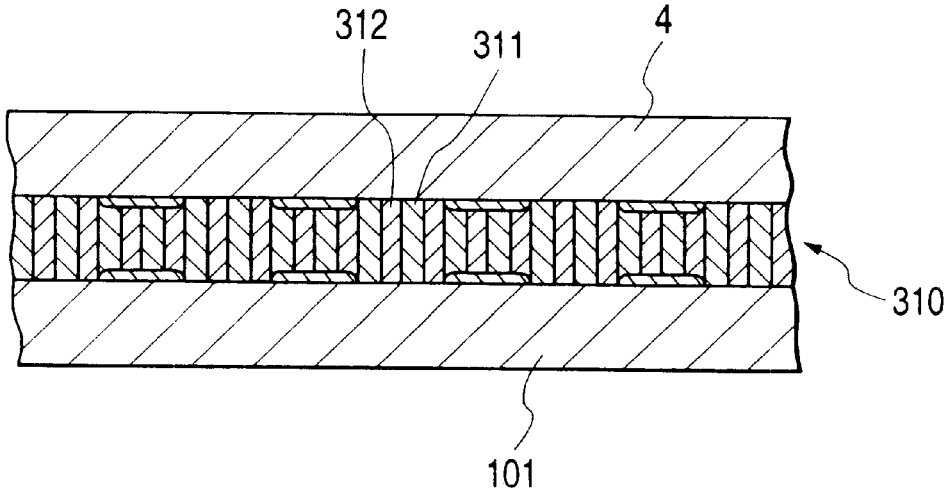
FIG. 12B PRIOR ART
Figure 13A:
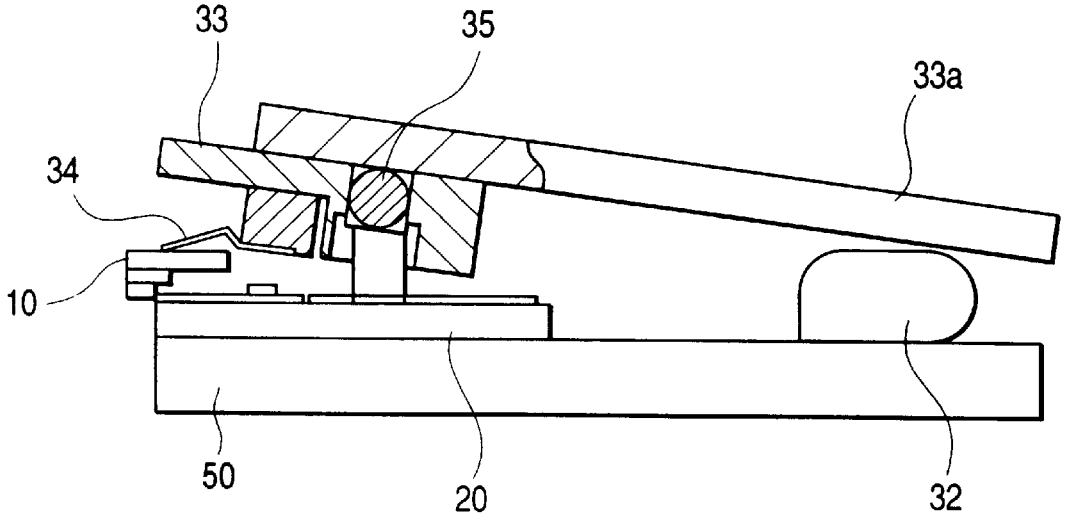
FIG. 13A PRIOR ART
FIGS. 13A and 13B are partially cut-off side views showing a press-fitting mechanism related to the background art.
Figure 13B:
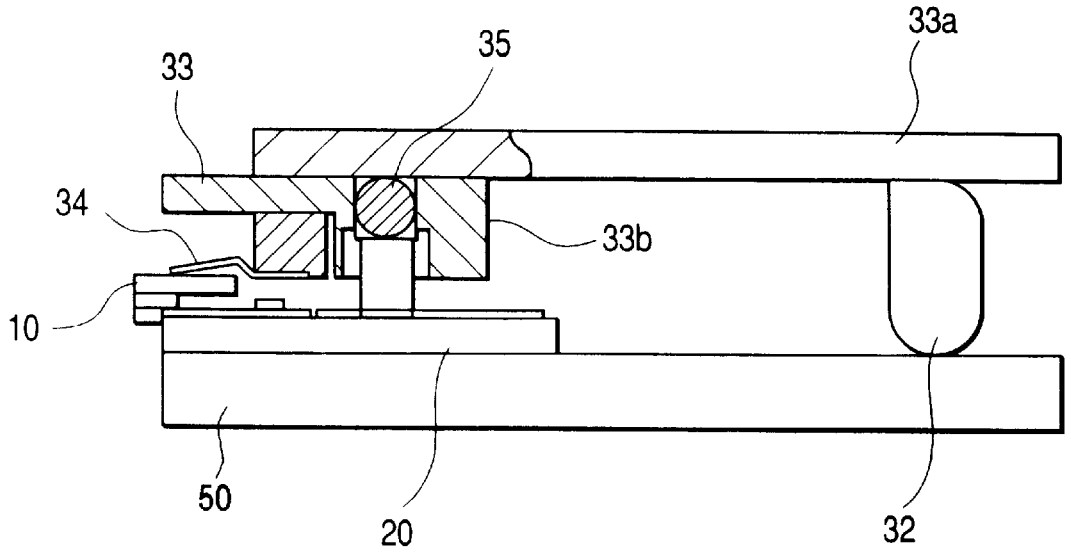
FIG. 13B PRIOR ART
Figure 14:
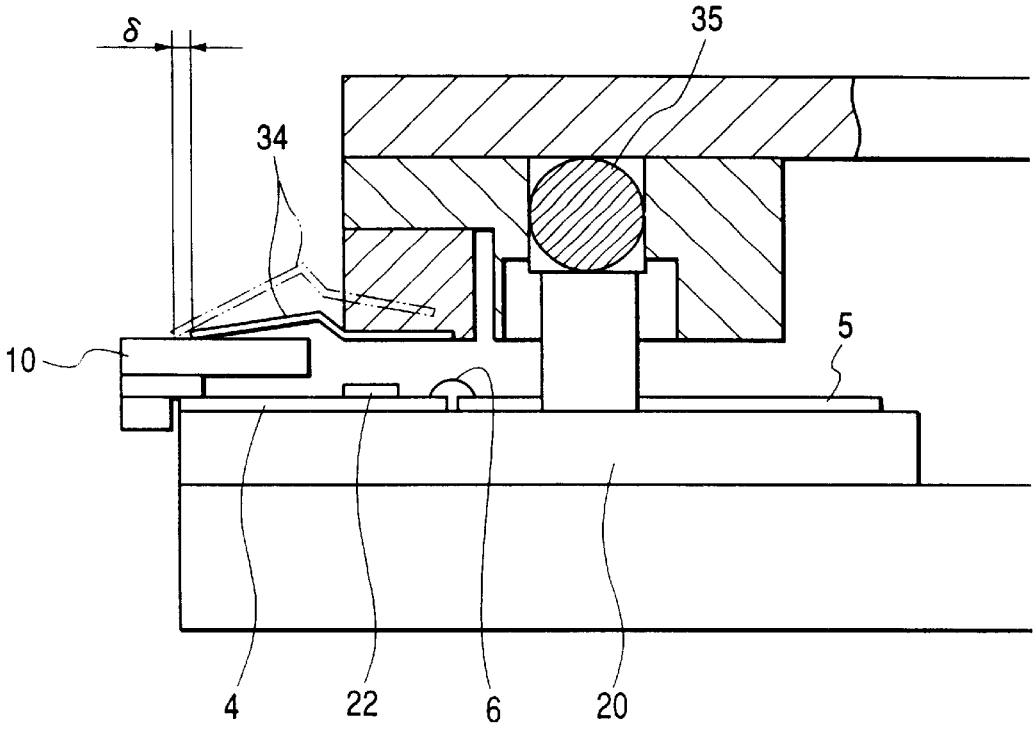
FIG. 14 PRIOR ART
FIG. 14 is a partially enlarged cut-off side view of FIG. 11.

Note that the present invention may provide such a construction that an electric connecting member is interposed between the two connecting terminals 110, 23 as in the examples shown in FIGS. 11, 12A and 12B. Another construction may be such that the rotary shaft of the pressing force transmission member and the rotary shaft of the press-fitting plate are supported not on the driving element unit 20 but on the head base 50. Moreover, the recording element unit and the driving element unit may be switched with each other in terms of their positions.

(Liquid Jet Apparatus)

Figure 15:
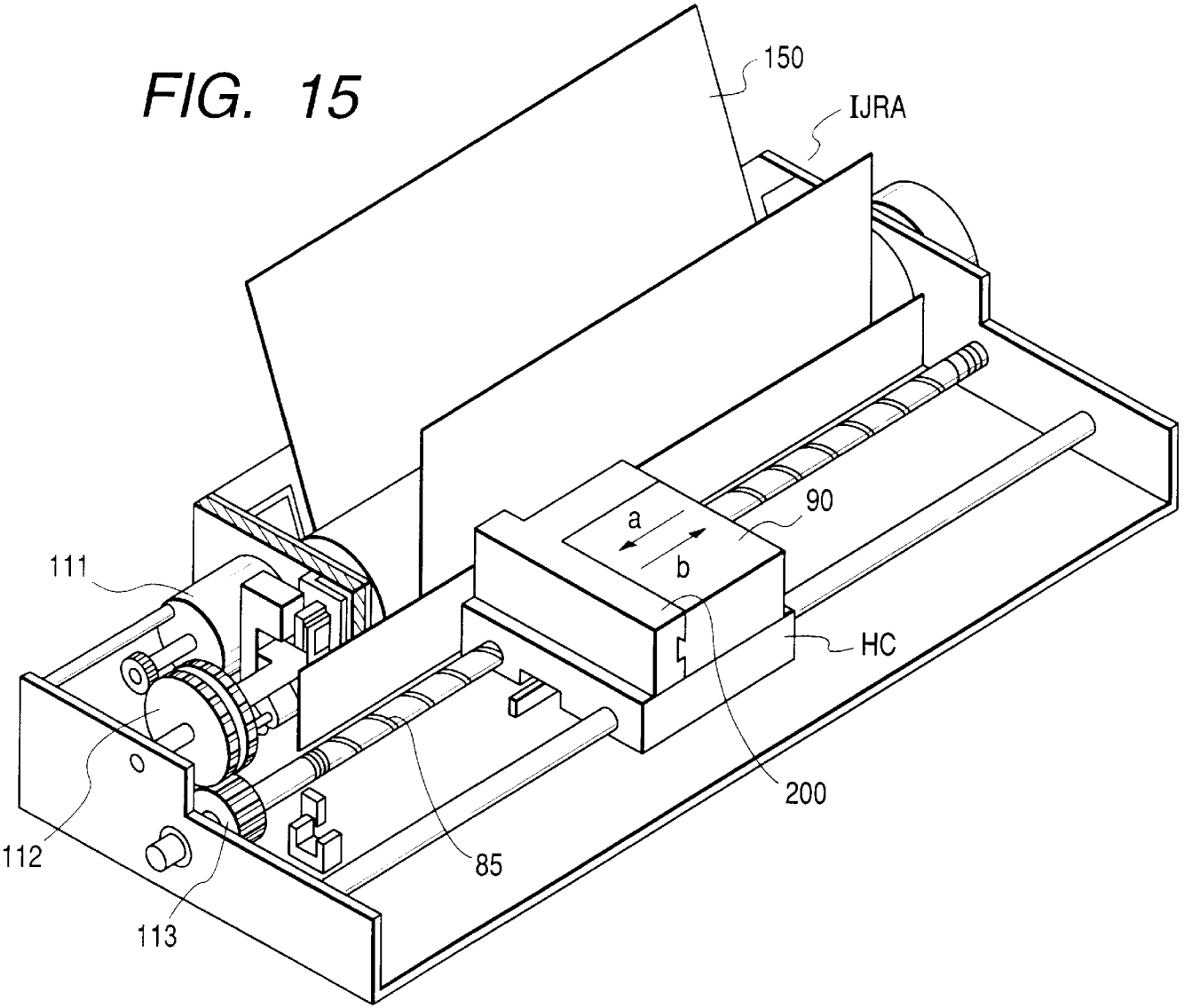
FIG. 15 is a perspective view showing the principal portion of an ink jet recording apparatus.

FIG. 15 schematically illustrates a construction of a liquid jet apparatus mounted with the above described liquid jet head. In this embodiment, particularly an ink jet recording apparatus IJRA using inks as liquids to be jetted will be exemplified. A carriage HC of the liquid jet apparatus is mounted with a head cartridge to and from which a liquid container 90 for containing the inks and a liquid jet head member 200 are attachable and detachable. The carriage HC reciprocates in widthwise directions (indicated by arrows a and b) of the recorded medium such as a record sheet etc. carried by a recorded medium carrier unit.

Referring to FIG. 15, when an unillustrated driving signal supply unit supplies a driving signal to a liquid jet unit on the carriage HC, a recording liquid is jetted out of the liquid jet head member 200 to a recorded medium 150 in accordance with the driving signal.

Further, the liquid jet apparatus in this embodiment includes a motor 111 serving as a driving source for driving the recorded medium carrier unit and the carriage HC, gears 112, 113 for transmitting the power to the carriage HC from the driving source, and a carriage shaft 85. Based on the recording apparatus and a liquid jetting method of the present invention which is carried out by the recording apparatus, a well-recorded image could be obtained by jetting the liquids to a variety of recorded mediums.

Figure 16:
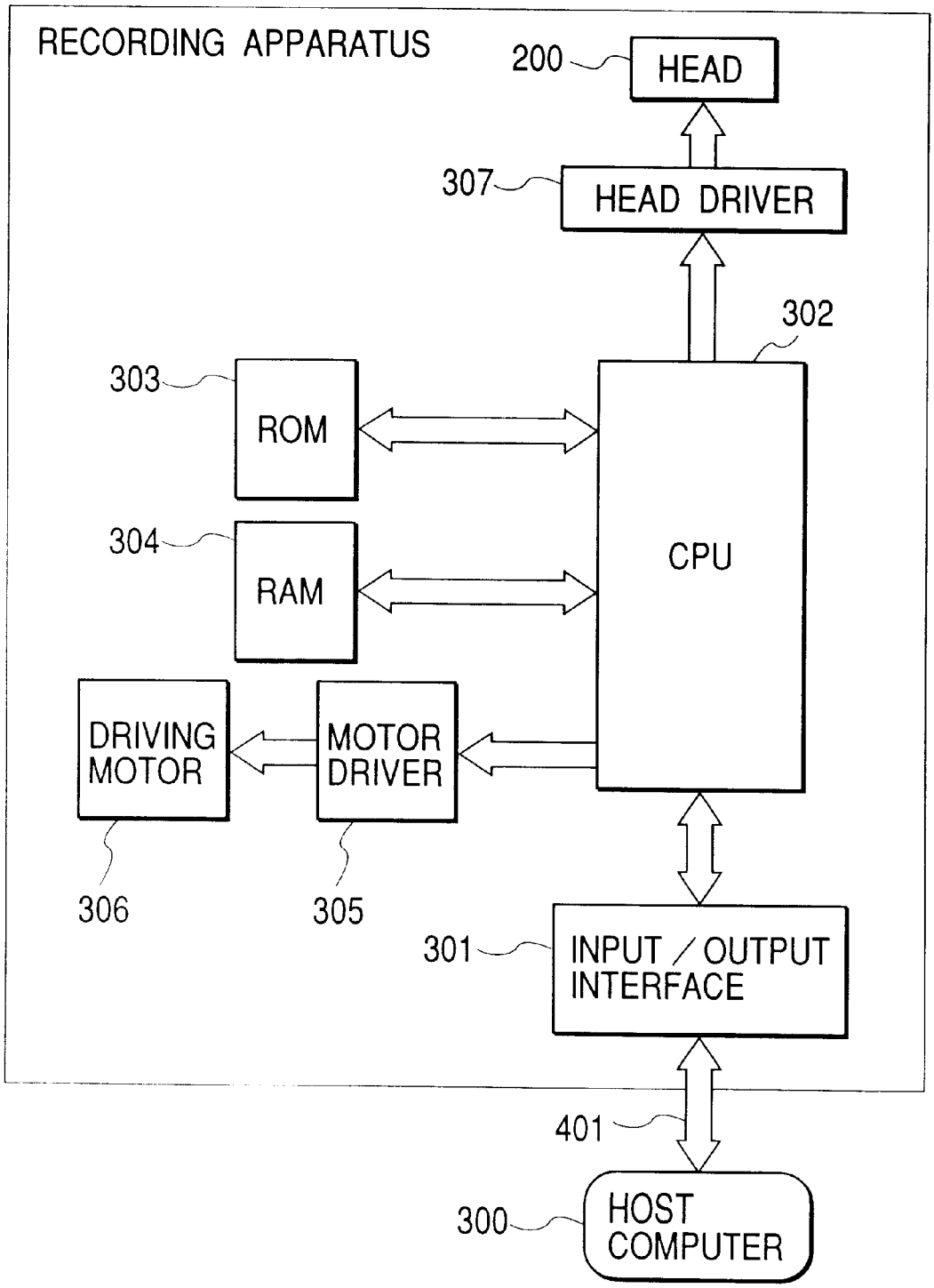
FIG. 16 is a block diagram of the ink jet recording apparatus.

FIG. 16 is a block diagram showing a whole apparatus for operating the ink jet recording apparatus to which the liquid jet head of the present invention is applied. The recording apparatus receives print information as a control signal from a host computer 300. The print information is temporarily stored in an I/O interface 301 within a printing apparatus as well as being converted into data which can be processed in the recording apparatus, and is inputted to a CPU 302 serving also as a head driving signal supply unit. The CPU 302 processes the data inputted to the CPU 302 by use of a peripheral unit such as a RAM 304 etc. and converts the data into print data (image data) on the basis of a control program stored in a ROM 303.

Further, the CPU 302 creates drive data for driving a drive motor 306 for moving a head 200 and the record sheet in synchronization with the image data in order to record the image data in a proper position on the record sheet. The image data and the motor drive data are transmitted to the head 200 and the driving motor 306 respectively through a head driver 307 and a motor driver 305, and the head 200 and the driving motor 306 are driven respectively at controlled timings, thereby forming an image.

The recorded medium, applicable to the above-described recording apparatus, onto which the liquid such as the ink is jetted, may include various sheets of paper, an OHP sheet, a plastic material used for a compact disk and a decoration plate etc., a dishcloth, a metallic material such as aluminum and cooper etc., a leather material such as a cowskin, a pigskin and an artificial leather etc., a wood material such as wood and plywood etc., a bamboo material, a ceramic material like a tile, and a three-dimensional structure such as a sponge etc.

Moreover, the recording apparatus described above may include a printer apparatus for recording on the various sheets of paper and the OHP sheet, a plastic-oriented printing apparatus for recording on the plastic material such as the compact disk etc., a metal-oriented recording apparatus for recording on a metal plate, a leather-oriented recording apparatus for recording on the leather, a wood-oriented recording apparatus for recording on the wood, a ceramic-oriented recording apparatus for recording on the ceramic material, a recording apparatus for recording on the three-dimensional mesh structure such as the sponge etc., and a textile printing apparatus for printing on the dishcloth.

Further, the liquids adapted to the respective recorded mediums and meeting with record conditions may be used as the jet liquids used for these liquid jet apparatuses.

(Recording System)

Figure 17:
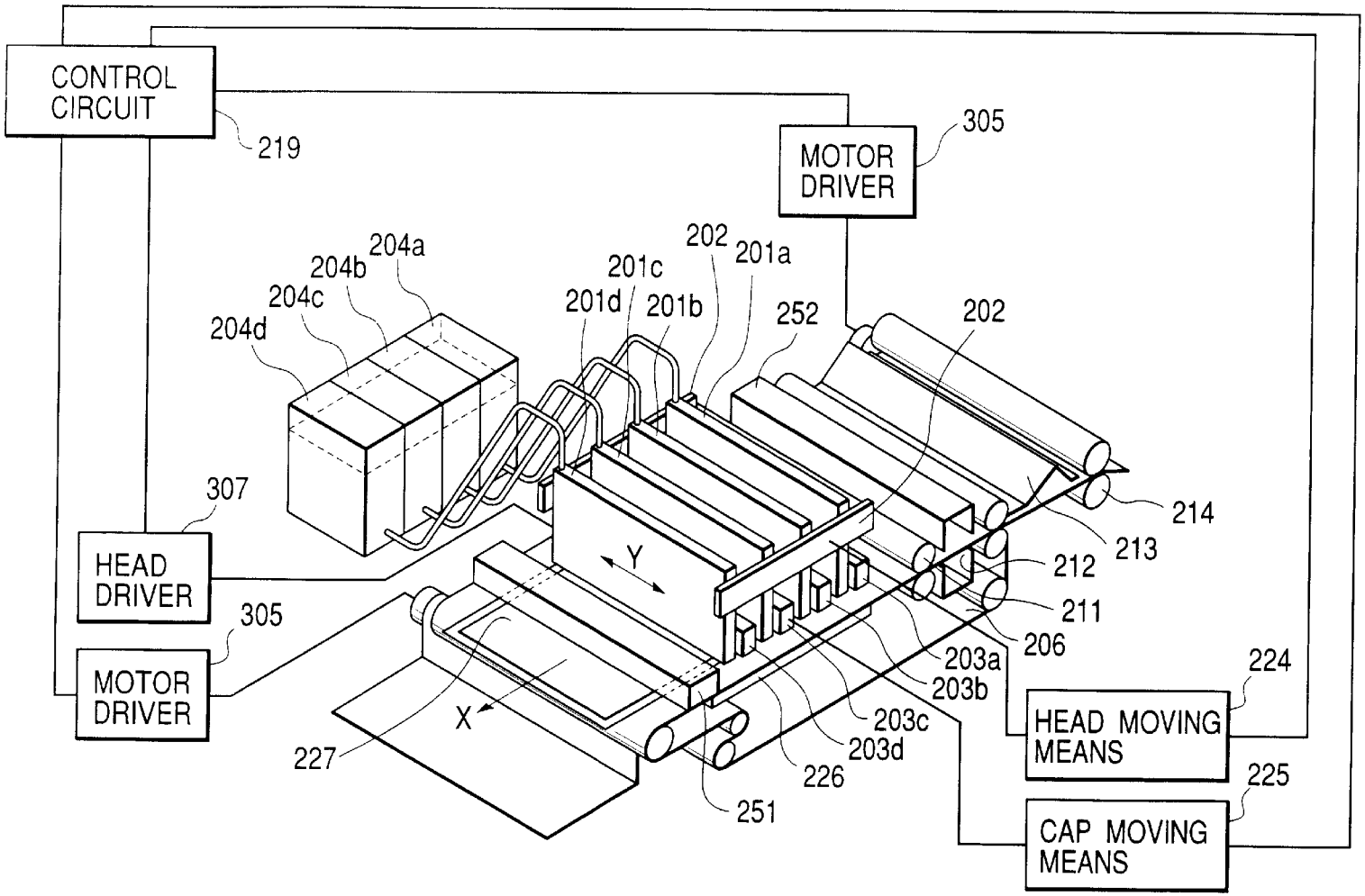
FIG. 17 is a perspective view showing the principal portion of an ink jet recording system.

Given next is an explanation of one example of an ink jet recording system for recording on the recorded medium by use of the liquid jet heat of the present invention as a recording head. FIG. 17 is an explanatory schematic diagram showing a construction of the ink jet recording system using the liquid jet head of the present invention, which has been described so far. The liquid jet heat in this embodiment is classified as a full-line type head in which a plurality of orifices are arranged at an interval of 360 dpi to a length corresponding to a recordable width of a recorded medium 150, and a holder 202 fixedly holds four heads 201*a* to 201*d* corresponding to four colors, yellow (Y), magenta (M), cyan (C) and black (B) which are disposed in parallel to each other at a predetermined interval in a direction X.

A head driver 307 constituting the driving signal supply unit supplies each of these heads 201*a* to 201*d* with a signal, and each of the heads 201*a* to 201*d* is driven based on this signal. The heads 201*a* to 201*d* are supplied with the inks in four colors of Y, M, C, Bk as jetting liquids.

Further, head caps 203*a* to 203*d* each incorporating an ink absorbing member such as a sponge etc, are provided downwardly of the heads 201*a* to 201*d* and cover the orifices of the heads 201*a* to 201*d* when in a non-recording process, thereby performing maintenance of the heads 201*a* to 201*d*. The numeral 206 designates a carrier belt constituting a carrier device for carrying the variety of recorded mediums explained in the embodiments discussed above. The carrier belt 206 is extended along a predetermined route through a variety of rollers, and is driven by a driving roller connected to the motor driver 305.

In the ink jet recording system in this embodiment, a pre-treatment apparatus 251 and a post-treatment apparatus 252 for executing a variety of treatments upon the recorded medium before and after recording are individually disposed upstream and downstream of a recorded medium carrier route. The pre-treatment and the post-treatment have different contents depending upon a type of the recorded medium on which to effect recording and a kind of the ink. The recorded medium composed of, e.g., the metal, plastic and ceramic etc. is irradiated with ultraviolet rays and ozone as the pre-treatment, and the surface thereof is thus activated, whereby an adhesion of the ink can be enhanced. Furthermore, in the recorded medium composed of the plastic etc in which the static electricity is easily generated, dusts are easy to adhere to the surface by the static electricity, and an ill-recorded state might occur due to the dusts in some cases.

Therefore, the static electricity is removed out of the recorded medium by use of an ionizer as the pre-treatment, thus removing the dusts from the recorded medium. Further, when the dishcloth is used as the recorded medium, there may be executed a treatment, as the pre-treatment, of applying to the dishcloth a substance selected out of an alkalic substance, a water-soluble substance, a synthetic high polymer, water-soluble metallic salt, urea and thio-urea in terms of preventing a blur and enhancing a degree of exhaustion. The pre-treatment is not limited to this treatment but may be a treatment of setting a temperature of the recorded medium to a temperature optimal to the record. On the other hand, as the post-treatment, there are executed a thermal treatment upon the recorded medium to which the ink is jetted, a fixing treatment of speeding up the fixation of the ink by the irradiation of the ultraviolet rays, and a treatment of cleaning a residual treatment agent applied in the pre-treatment but remaining non-reacted.

Note that the full-line heads have been exemplified as the heads 201*a* to 201*d* in this embodiment, however, the heads are not limited to those described above, and there may be taken such a type that the small-sized head explained above is moved in the widthwise directions of the recorded medium thus effects the record.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An ink jet recording head comprising:

a recording element unit including a recording element for generating an energy utilized for jetting an ink, and a recording element connecting terminal connected to said recording element;

a driving element unit including a driving element for driving said recording element, and a driving element connecting terminal connected to said driving element;

a pressing force generating mechanism for generating a pressing force for pressing said recording element unit and said driving element unit in such a direction as to make said recording element unit and said driving element unit proximal to each other so that said recording element connecting terminal and said driving element connecting terminal are connected to each other; and a rigid and non-resilient pressing force transmission member interposed between said pressing force generating mechanism and said recording element unit or said driving element unit for transmitting the pressing force to said recording element unit or said driving element unit while coming into contact with said recording element unit or said driving element unit so that the pressing force given from said pressing force generating mechanism acts upon a connecting portion between said recording element connecting terminal and said driving element connecting terminal.

2. An ink jet recording head according to claim 1, comprising a plurality of recording element connecting terminals and a plurality of driving element connecting terminals, each arranged linearly, wherein said pressing force transmission member makes the pressing force act directly upon linear regions corresponding to said plurality of recording element connecting terminals and said plurality of driving element connecting terminals.

3. An ink jet recording head according to claim 2, wherein said plurality of recording element connecting terminals and said plurality of driving element connecting terminals are arranged on a first and a second surface, respectively, and the pressing force acts in a direction substantially perpendicular to the first and second surfaces.

4. An ink jet recording head according to claim 1, wherein said pressing force transmission member rotates and thus comes into contact with and separates from said recording element unit or said driving element unit.

5. An ink jet recording head according to claim 4, wherein a central axis of the rotation of said pressing force transmission member is substantially flush with a contact position between said pressing force transmission member and said recording element unit or said driving element unit.

6. An ink jet recording head according to claim 4, wherein a central axis of the rotation of said pressing force transmission member is held by said recording element unit or said driving element unit.

7. An ink jet recording head according to claim 1 or 4, wherein said pressing force generating mechanism rotates and thus becomes proximal to and released from said recording element unit or said driving element unit.

8. An ink jet recording head according to claim 7, wherein a central axis of the rotation of said pressing force generating mechanism is positioned higher than the central axis of the rotation of said pressing force transmission member.

9. An ink jet recording head according to claim 7, wherein the central axis of the rotation of said pressing force generating mechanism is held by said recording element unit or said driving element unit.

10. An ink jet recording head according to claim 1, wherein said pressing force transmission member comprises a plurality of pressing force transmission sub-members in an array direction of said recording element of said recording element unit.

11. An ink jet recording head according to claim 10, wherein said pressing force generating mechanism comprises a plurality of pressing force generating sub-mechanisms corresponding to said plurality of divided pressing force transmission sub-members.

12. An ink jet recording head according to claim 1, wherein said recording element connecting terminal and said driving element connecting terminal are connected directly to each other.

13. An ink jet recording head according to claim 1, wherein said recording element connecting terminal and said driving element connecting terminal are connected to each other through an electric connecting member.

14. An ink jet recording head according to claim 1, wherein said electric connecting member comprises a plurality of conductive members embedded in a sheet-like insulation holding body.

15. An ink jet recording head according to claim 14, wherein said recording element is an exothermic element for generating thermal energy for jetting an ink.

16. An ink jet recording apparatus comprising the ink jet recording head of claim 1, said apparatus further comprising:

a member for mounting said ink jet recording head.

17. An ink jet recording head comprising:

a recording element unit including a recording element for generating an energy utilized for jetting an ink, and a recording element connecting terminal connected to said recording element;

a driving element unit including a driving element for driving said recording element, and a driving element connecting terminal connected to said driving element;

a pressing force generating mechanism for generating a pressing force for pressing said recording element unit and said driving element unit in such a direction as to make said recording element unit and said driving element unit proximal to each other so that said recording element connecting terminal and said driving element connecting terminal are connected to each other; and a rigid and non-resilient pressing force transmission member interposed between said pressing force generating mechanism and said recording element unit or said driving element unit for transmitting the pressing force to said recording element unit or said driving element unit while coming into contact with said recording element unit or said driving element unit so that the pressing force given from said pressing force generating mechanism acts upon a connecting portion between said recording element connecting terminal and said driving element connecting terminal, wherein said pressing force generating mechanism includes a resilient member for absorbing the pressing force.

18. An ink jet recording head according to claim 17, wherein said pressing force generating mechanism includes a cam for directly or indirectly moving said resilient member.

* * * * *

UNITED STATES PATENT AND TRADEMARK OFFICE

CERTIFICATE OF CORRECTION

PATENT NO. : 6,209,988 B1
DATED : April 3, 2001
INVENTOR(S) : Manabu Sueoka et al.

It is certified that error appears in the above-identified patent and that said Letters Patent is hereby corrected as shown below:

Column 1,
Line 16, "etc," should read -- etc., --; and
Line 48, "One edge" should read -- One-edge --.

Column 2,
Line 6, "elements)-disposed" should read -- elements) disposed --; and
Line 46, "etc" should read -- etc. --.

Column 3,
Line 39, "partially-cut-off" should read -- partially cut-off --.

Column 4,
Line 7, "6" should read -- δ --; and
Line 13, "a" should be deleted.

Column 5,
Line 24, "etc," should read -- etc., --.

Column 6,
Line 21, "have" should read -- have been --.

Column 7,
Line 26, "40 impinges" should read -- and impinges --;
Line 49, "units" should read -- unit --; and
Line 53, "both of" should read -- both --.

Colunm 8,
Line 40, "10. There by" should read -- 10, thereby --.

Column 9,
Line 26, "pres-fitting" should read -- press-fitting --; and
Line 35, "pressing-force" should read -- pressing force --.

Column 11,
Line 47, "etc," should read -- etc., --

UNITED STATES PATENT AND TRADEMARK OFFICE

CERTIFICATE OF CORRECTION

PATENT NO. : 6,209,988 B1
DATED : April 3, 2001
INVENTOR(S) : Manabu Sueoka et al.

It is certified that error appears in the above-identified patent and that said Letters Patent is hereby corrected as shown below:

Column 12,
Line 3, "etc" should read -- etc. --.

Signed and Sealed this

Twenty-sixth Day of March, 2002

*Attest:*

*Attesting Officer*

JAMES E. ROGAN
*Director of the United States Patent and Trademark Office*